United States Patent [19]

Jahn

[11] Patent Number: 4,932,186

[45] Date of Patent: Jun. 12, 1990

[54] REINFORCED BEAD

[75] Inventor: Martin D. Jahn, Chicago, Ill.

[73] Assignee: Chicago Metallic Corporation, Chicago, Ill.

[21] Appl. No.: 333,962

[22] Filed: Apr. 6, 1989

[51] Int. Cl.[5] ..... E04B 5/52

[52] U.S. Cl. ..... 52/729; 52/484; 52/720; 52/730

[58] Field of Search ..... 52/729, 730, 731, 664–667, 52/484, 488, 720, 732

[56] References Cited

U.S. PATENT DOCUMENTS

| | | | |
|---|---|---|---|
| Re. 31,528 | 3/1984 | Mieyal | 52/484 |
| 991,603 | 5/1911 | Brooks . | |
| 2,448,362 | 8/1948 | Earhart . | |
| 4,189,893 | 2/1980 | Kuhr | 52/484 X |
| 4,409,771 | 10/1983 | Lowe . | |
| 4,455,806 | 6/1984 | Rice . | |
| 4,520,609 | 6/1985 | Worley et al. | 52/484 |
| 4,852,325 | 8/1989 | Dunn et al. | 52/729 |

FOREIGN PATENT DOCUMENTS

| | | | |
|---|---|---|---|
| 2634576 | 2/1978 | Fed. Rep. of Germany . | |
| 3525139 | 1/1987 | Fed. Rep. of Germany | 52/484 |
| 1068482 | 6/1954 | France . | |
| 1392544 | 2/1965 | France | 52/484 |
| 827723 | 5/1981 | U.S.S.R. . | |
| 545200 | 3/1940 | United Kingdom . | |

OTHER PUBLICATIONS

"Heavy Duty Main Tee" 3-6-64, Donn Products, Inc., Westlake, Ohio.

*Primary Examiner*—Richard E. Chilcot, Jr.

*Attorney, Agent, or Firm*—Hill, Van Santen, Steadman & Simpson

[57] ABSTRACT

A grid tee for suspended ceiling systems having a central web with a reinforced, substantially circular bead on one edge of the web and a pair of flanges. The reinforced bead can be composed of a double layer, which layers are interconnected by reversed bends adjacent to the web so that the web extends into the bead. In another embodiment, the bead is a closed circular bead having portions of three layers interconnected by reversed bends adjacent to the layers of the web with the outer layer of each portion being a continuous layer.

12 Claims, 1 Drawing Sheet

REINFORCED BEAD

BACKGROUND OF THE INVENTION

The present invention is directed to a grid tee for a suspended ceiling or the like, which has a central web, a continuous bead on one edge of the web and a pair of flanges extending outwardly from the other edge. The bead has a circular cross section with a substantially continuous outer layer to provide a continuous surface on a surface facing away from the flanges and, in order to concentrate more metal in the bead, portions of the surface of the bead are two layers thick connected by a reversed bend.

Grid tees for suspended ceiling systems have been used for many years. Usually, the grid tee is formed by a sheet of material which has been bent to form a bead along one edge of a central web and opposed or outwardly extending flanges adjacent the other edge so that the cross section of the tee has an inverted T configuration. It is known to bend the sheet so that the web has two thicknesses and the flanges are each a single layer extending outward, which flanges may be covered by a cap strip so that the portion exposed to the occupants of the room can have any desired finish or color.

Recently, it has been suggested to form the grid tee out of a metal strip with a thinner gauge than previously. However, to maintain the rigidity of the component and to prevent rotation or buckling due to loading, arrangements have been made or suggested for reinforcing the bead or bulb of the tee. Examples of two approaches of forming a grid tee out of thin gauge metal with a reinforced bulb are disclosed in a patent to David F. Mieyal, U.S. Pat. No. Re. 31,528; and the U.S. Patent to Worley et al, U.S. Pat. No. 4,520,609. In the Reissue Patent, the reinforcing is by putting a second or an additional strip of metal in the area of the strip of metal which will be bent into the bulb. While this procedure allows utilizing a heavier sheet of metal for the insert than the rest of the strip used for the tee, there are problems with maintaining the additional sheet in the desired position while bending and forming the main strip into the grid tee.

In the solution suggested by the Worley et al patent, the top of the hollow bead or bulb has a plurality of folds so that a larger amount of material is concentrated at the extremity of the bulb relative to the web to increase the strength of the bulb and to shift the shear center into the web of the tee. However, the solution in Worley results in abutting edges of folds on the outer or top surface of the bead, and these abutting edges of the folds or seams may tend to buckle, due to bending of the tee.

Another type of reinforced bead is disclosed in the copending allowed U.S. patent application Ser. No. 296,853, filed Jan. 13, 1989, which issued as U.S. Pat. No. 4,852,325 and was a continuation of U.S. Ser. No. 112,549, abandoned filed Oct. 26, 1987, and whose disclosure is incorporated by reference. In this copending application, various species were mentioned in which either the bead had a hollow configuration which was either rectangular or triangular or the bead had a solid configuration of a plurality of layers.

SUMMARY OF THE INVENTION

The object of the present invention is to provide a reinforced bead having a circular configuration in which a thin gauge material can be used for forming the grid tee for a suspended ceiling. The object involves folding the strip of material so that there are no exposed abutting seams in an upper and outermost surface of the bead and so that the additional metal is added to the bead to not only shift the neutral axis along the web, but to increase the moment of inertia of the bead section about its vertical centroid axis. This allows putting the metal along the vertical plane of the bead with a more efficient use of the metal and also localizes the area against buckling.

To accomplish these goals, the present invention is directed to a grid tee for a suspended ceiling system, said grid tee having a central web, a reinforced bead on one edge of the web and a pair of oppositely extending panel support flanges on an edge of the web opposite said bead, said tee comprising an elongated strip of metal bent substantially along a center line to form the bead with a double layer central web extending from the bead and being bent to form the flanges, said bead having an outer curved layer to form a substantially circular cross section, said outer layer terminating at each end in a reversed bend to provide at least a portion of the bead with a two-layer thickness, said outer curved surface forming a continuous outer surface for a side of the bead facing opposite said flanges.

In one embodiment of the invention, the bead has an opened circular configuration with the walls of the circular bead being a double layer, with the inner layer of the double layer being connected to the central web by a bend greater than a right angle. The reversed bends are adjacent to the center web and has portions spaced from the connection to the inner layer and the spacing between the reversed bend and the web can be either open or substantially closed.

In another embodiment of the invention, the circular bead has a closed configuration wherein only approximately half of the bead has more than one layer and that portion has a three-layer thickness because of two reversed bends. In this particular embodiment, the portions with the reversed bends are adjacent the center web.

Other advantages and features of the present invention will be readily apparent from the following description of the preferred embodiments, the drawings and claims.

DESCRIPTION OF THE PREFERRED EMBODIMENTS

Figure 1:
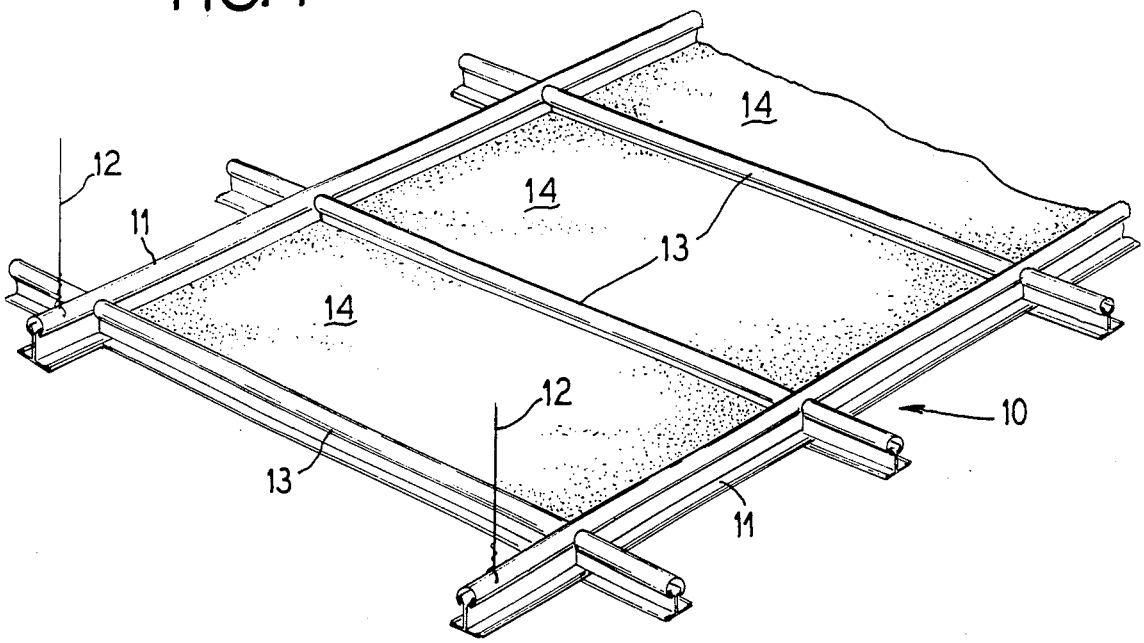
FIG. 1 is a perspective view with portions broken away for purposes of illustration of a suspended ceiling illustrating the manner in which the typical grid is often assembled to support ceiling panels.
Figure 2:
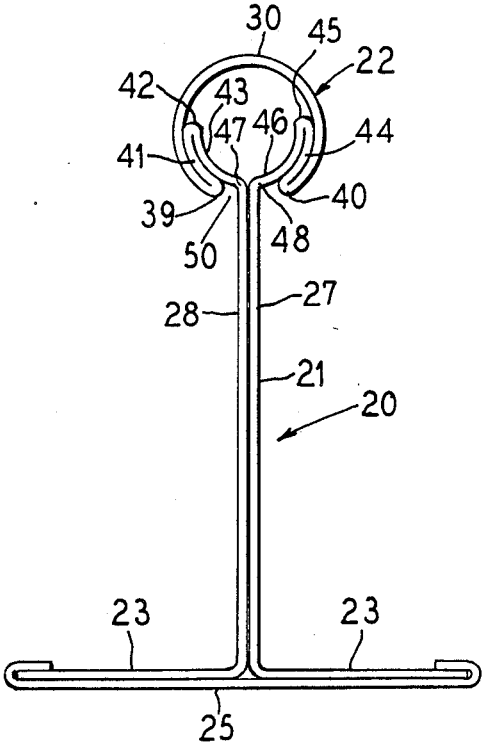
FIG. 2 is an end view of a grid member used in the sealing system of FIG. 1.

The principles of the present invention are particularly useful when incorporated in a grid member, generally indicated at 20 in FIG. 2, for use in a ceiling system, generally indicated at 10 in FIG. 1.

The ceiling system 10 has a plurality of main runners, such as 11, which are supported by wires 12 at a given height for the ceiling. Extending between the main runners 11 are cross members or runners 13, which are connected to the main runner 11 at a given distance or spacing along the main runners to form rectangular openings for receiving panels 14.

Each of the runners 11 and 13 are grid tee members, such as the grid tee member 20 of FIG. 2. The grid tee member 20 has a central web 21 with a reinforced hollow circular bead 22 on one edge, which is the upper edge, and a pair of flanges 23, 23, that extend in opposite directions along the opposite edge.

In the illustrated embodiment of a ceiling system 10 of FIG. 1, the panels 14 rest on the flanges, such as 23, and, because of the presence of a cap strip 25, the only portion of the grid members visible to occupants of the room having the suspended ceiling, is the cap strip 25. This cap strip 25 can have various colors and/or finishes to provide the desired appearance.

In order to provide or form the grid or beam member 20 of a thinner gauged strip of material to save weight and material, the bead 22 must be reinforced to obtain the desired rigidity for the beam member. In the embodiment of FIG. 2, the grid member 20 has been formed out of a single sheet of material which is bent along its axis or center line to form the hollow, circular bead 22, the double layer central web 21 with layers 27 and 28 and the two flanges 23. As illustrated, the bending has resulted in a plurality of right angle bends, plus some reversed bends so that a hollow bead has a circular configuration with a continuous upper layer 30. The upper layer 30 terminates adjacent the central web 21 at a reversed bend 39 and 40, respectively. The reversed bend 39 forms an intermediate layer portion 41, which is connected by a second reversed bend 42 to an inner layer portion 43. In a similar manner, the reversed bend 40 connects the outer continuous layer 30 to an intermediate layer 44, which is connected by a reversed bend 45 to an inner layer 46. The inner layer 43 is connected by a bend 47 to a layer 28 of the central web 21 and the inner layer 46 is connected by a bend 48 to a layer 27.

As illustrated in FIG. 2, the length of the intermediate layers 41 and 44 is such that the reversed bends 42 and 45, respectively, are approximately on a line passing through a center of the circular bead 22. Thus, the bead has a single layer for approximately ½ of a circle. The bead has a portion on each side which has a three-layer thickness, which provides additional metal to reinforce the bead. In addition, because the reversed bends or folds 39 and 40 are adjacent the center web, the upper surface of the layer 30 is smooth and continuous for over 180° and, preferably, more than 270° to provide a pleasing appeal. It is noted that the reversed bend, such as 40, is spaced from the center web 21 by a small gap 50. If desired, this small gap can be decreased to cause a corresponding increase in the segmental or arcuate length of the three-layer portion. It is also possible to increase the gap to reduce the arcuate or segmental length of the three-layer portion.

Figure 3:
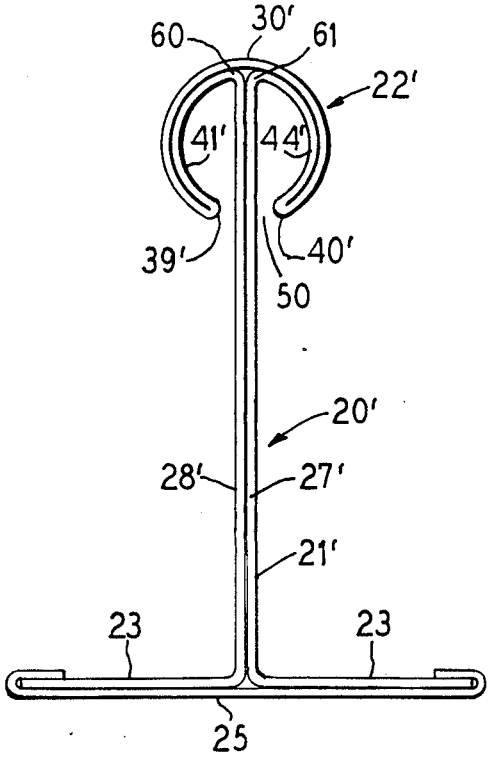
FIG. 3 is an end view of a modification of a grid member of FIG. 2.

In FIG. 3, a modification or embodiment of the grid tee is generally indicated at 20'. This embodiment has a central web 21', a bead 22', and a pair of flanges 23, 23. Also, as in the embodiment of FIG. 2, the flanges are covered by a cap 25. The bead 22' has an open, circular cross sectional configuration, which is formed by an outer portion 30' which terminates adjacent the center web with reversed bends, such as 39' and 40'. The reversed bend 39' connects the outer layer 31' to an inner layer 41', which is connected to a layer 28' of the central web 21' by a bend 60. In a similar manner, the reversed bend 40' connects an inner layer 44' which, at the other end, is connected to a layer 27' of the central web 21' by a bend 61. As illustrated, the outer layer 30' and the two inner layers 41' and 42' form a double-layer, circular bead which has an opened configuration with gaps, such as 50', adjacent the central web 21' As with the grid 20 of FIG. 2, the gap 51' can be adjusted to be either of a greater dimension or a lesser dimension with a corresponding change in the arcuate or segmental length of the double portions of the bead. Also, it is noted that, as with the previous embodiment, the outer layer 30' provides a continuous outer surface, except for the gap, such as 50'. Preferably, the combined arcuate width of the gaps 50' is less than 90° so that the double portion has a continuous outer surface of more than 270° and, preferably, over 300°.

The double layer provides an increased amount of metal in the bead for the corresponding increase in the strength of the bead to resist buckling. This increase metal, which is added to the bead, will shift the neutral axis along the web and increase the moment of inertia of the bead section about its vertical centroidal axis.

Although various minor modifications may be suggested by those versed in the art, it should be understood that I wish to embody within the scope of the patent granted hereon all such modifications as reasonably and properly come within the scope of my contribution to the art.

I claim:

1. A grid tee for a suspended ceiling having a central web, a reinforced bead on one edge of the web and a pair of oppositely extending panel support flanges on an edge of the web opposite said bead, said tee comprising an elongated strip of metal bent substantially along the center line to form the bead with a double-layer, central web extending from the bead and being bent to form the flanges, said bead having a substantially circular cross sectional configuration and having an outer continuous layer terminating at edges adjacent the central web with a reversed bend to form at least a portion of the bead with at least a double-layer thickness.

2. A grid tee according to claim 1, wherein each of the double-layer portions has only two layers with the inner layer being connected to a layer of the central web.

3. A grid tee according to claim 2, wherein the outer layer of the bead has a circumferential segment of over 300°.

4. A grid tee according to claim 2, wherein the central web extends into the circular bead.

5. A grid tee according to claim 1, wherein the bead has a hollow, closed configuration, each of said double-layer portions terminating with a second reversed bend which is connected by a third layer to a layer of the double-layer central web.

6. A grid tee according to claim 5, wherein the bead has a portion of a single layer.

7. A grid tee according to claim 6, wherein said portion of a single layer has an arcuate length of approximately ½ of a circle.

8. A grid tee for a suspended ceiling having a central web, a reinforced bead on one edge of the web and a pair of flanges extending at opposite directions from an opposite edge of the web for supporting panels, said tee comprising an elongated strip being bent along a center line to form a bead with a double-layer central web extending from the bead and being bent to form the flanges, said bead having a hollow, circular configuration with portions of the circular periphery of the bead being composed of multiple layers interconnected by reversed bends.

9. A grid tee according to claim 8, wherein the multilayer portions are adjacent the central web and the remaining portion of the circular bead is a single layer providing a continuous outer surface for over 180°.

10. A grid tee for a suspended ceiling, said tee having a central web, a reinforced bead on one edge of the web and a pair of oppositely extending panel supporting flanges on an edge of the web opposite said bead, said tee comprising an elongated strip of metal bent substantially along a center line to form the bead with a double-layer central web extending from the bead and being bent to form the flanges, said bead being a double-layer, curved bead with an outer continuous layer connected by two reversed bends to inner layers that are connected by bends to the layers of said web.

11. A grid tee according to claim 10, wherein each of the reversed bends is spaced by a gap from the central web, which extends into the circular bead.

12. A grid tee according to claim 11, wherein the total arcuate length of the gaps is less than 90° so that the total arcuate length of the outer continuous layer is more than 270°.

* * * * *